US009556747B2

(12) United States Patent
Larcheveque et al.

(10) Patent No.: US 9,556,747 B2
(45) Date of Patent: Jan. 31, 2017

(54) METHODS FOR RETROFITTING A TURBOMACHINE

(71) Applicant: Dresser-Rand Company, Olean, NY (US)

(72) Inventors: Trevor Larcheveque, Alfred Station, NY (US); Steven Turybury, Wellsville, NY (US); Vincent Hood, Seattle, WA (US); Andrew Morrill, Seattle, WA (US); Rick Glover, Seattle, WA (US)

(73) Assignee: Dresser-Rand Company, Olean, NY (US)

( * ) Notice: Subject to any disclaimer, the term of this patent is extended or adjusted under 35 U.S.C. 154(b) by 450 days.

(21) Appl. No.: 14/093,760

(22) Filed: Dec. 2, 2013

(65) Prior Publication Data

US 2014/0150261 A1 Jun. 5, 2014

Related U.S. Application Data

(60) Provisional application No. 61/733,071, filed on Dec. 4, 2012.

(51) Int. Cl.
*F01D 21/18* (2006.01)

(52) U.S. Cl.
CPC ..... *F01D 21/18* (2013.01); *F05D 2230/80* (2013.01); *Y10T 29/49238* (2015.01); *Y10T 29/49716* (2015.01)

(58) Field of Classification Search
CPC ..... F01D 21/18; F05D 2230/80; Y10T 29/49238; Y10T 29/49716
See application file for complete search history.

(56) References Cited

U.S. PATENT DOCUMENTS

| | | | | | |
|---|---|---|---|---|---|
| 4,379,544 | A * | 4/1983 | Angelo | F01D 21/16 | 137/57 |
| 4,929,148 | A * | 5/1990 | Nutter | F01D 21/16 | 415/32 |
| 5,115,979 | A * | 5/1992 | Ellerhorst | F02K 1/805 | 239/127.3 |
| 6,082,393 | A * | 7/2000 | Tye | F01D 17/145 | 137/315.27 |
| 6,468,033 | B1 * | 10/2002 | Weidlich | F01D 17/02 | 415/118 |
| 6,837,474 | B1 * | 1/2005 | DeJonge | F01D 17/24 | 251/66 |
| 2006/0219815 | A1 * | 10/2006 | Hekman | B05B 3/0422 | 239/451 |

* cited by examiner

*Primary Examiner* — Sarang Afzali

(57) ABSTRACT

Methods for retrofitting a turbomachine are provided. A first trip cup of the turbomachine may be replaced with a second trip cup. The first trip cup may include a throw-out arm connected to a first trip cup spring. The second trip cup may include a plunger disposed in a hole defined by the second trip cup and a plunger spring encircling the plunger in the hole. The first trip cup may be removed from the turbomachine and the second trip cup installed such that a location of the plunger in the turbomachine is the same as a location of the throw-out arm in the turbomachine when the first trip cup was installed on the turbomachine. The tension in the plunger spring may be adjusted such that, when a speed of the turbomachine exceeds a predetermined value, the plunger actuates a trip paddle located adjacent the second trip cup.

20 Claims, 13 Drawing Sheets

-Prior Art-

-Prior Art-

-Prior Art-

-Prior Art-

-Prior Art-

METHODS FOR RETROFITTING A TURBOMACHINE

CROSS REFERENCE TO RELATED APPLICATIONS

This application claims priority to U.S. Provisional Patent Application having Ser. No. 61/733,071, which was filed Dec. 4, 2012. This priority application is hereby incorporated by reference in its entirety into the present application to the extent consistent with the present application.

BACKGROUND

Conventional steam turbines, for example, the Worthington single stage steam turbines, may use a trip cup (alternatively, referred to as a trip disk) having a throw out arm for shutting off a steam source supplying steam to the steam turbine when the steam turbine speed (generally measured in revolutions per minute (RPM)) exceeds a certain predetermined value, and a mechanical flyweight style governor for varying (increasing or decreasing) an amount of steam supplied from the steam source to the steam turbine to adjust (increase or decrease) the speed of the steam turbine as long as the predetermined value is not exceeded. The predetermined value indicates that the steam turbine is operating at overspeed. Overspeed refers to a condition in which the steam turbine runs at a speed beyond its design limit. For instance, the steam turbine may overspeed when there is no or little load while power is applied or when the governor malfunctions.

FIG. 1 illustrates a cross-sectional overview of a conventional steam turbine 100 including a trip cup 102 and a mechanical flyweight style governor 104. The trip cup 102 and the mechanical flyweight style governor 104 are enclosed in a housing 108. The trip cup 102 is connected to the shaft 110 of the steam turbine 100 and rotates with the shaft 110. The mechanical flyweight style governor 104 is connected to the shaft 110 and is also connected to a steam source 116 (FIG. 1C) via a system of governor linkages 106. The mechanical flyweight style governor 104 moves the governor linkages 106 based on the speed of the steam turbine 100. The motion of the governor linkages 106 varies the steam supplied from the steam source 116 to the steam turbine 100 and, in turn, adjusts the speed of the steam turbine 100. In this manner, the operating speed of the steam turbine 100 is maintained.

FIG. 1A illustrates an enlarged cross-sectional view of the trip cup 102 and the mechanical flyweight style governor 104 of the conventional steam turbine 100 of FIG. 1. The mechanical flyweight style governor 104 includes a coil spring 1041 surrounding the shaft 110 and two governor flyweights 1042 disposed adjacent the coil spring 1041. The coil spring 1041 is positioned between the two governor flyweights 1042 at an inner end (closer to the trip cup 102) of the coil spring 1041 and an outer collar 1043 at an outer end (farther from the trip cup 102) of the coil spring 1041. The two governor flyweights 1042 are disposed surrounding the shaft 110. The two governor flyweights 1042 are connected to the shaft 110 adjacent the inner end of the coil spring 1041. The two governor flyweights 1042 rotate with the shaft 110 and at the speed of the shaft 110. The outer collar 1043 is connected to the governor linkages 106 such that a compression of the coil spring 1041 moves the governor linkages 106. During operation, a centrifugal force acts on the two governor flyweights 1042 causing the two governor flyweights 1042 to move outward and away from the coil spring 1041. This action of the two governor flyweights 1042 compresses the coil spring 1041 and moves the governor linkages 106. The motion of the governor linkages 106 adjusts the amount of steam output from the steam source 116 to the steam turbine 100 to adjust the speed of the steam turbine 100.

FIG. 1B illustrates a cross-sectional view of the trip cup 102 taken along the line 1B-1B in FIG. 1A. The trip cup 102 defines an opening 1022 through which the shaft 110 of the steam turbine 100 extends. A partially drilled hole 1023 is defined by the body 1021 of the trip cup 102. The partially drilled hole 1023 extends radially inwards from an outer circumferential surface of the body 1021 toward the central axis of the trip cup 102. The partially drilled hole 1023 houses a weight spring 1024 disposed therein and connected to a first end 1027 of the throw out arm 1025. The throw out arm 1025 is located in a recess 1026 in the trip cup 102 and a second end 1028 of the throw out arm 1025 is connected to the trip cup 102. The tension in the weight spring 1024 is adjusted such that, when the rotational speed of the steam turbine 100 exceeds the predetermined value, the throw out arm 1025 flies out from the trip cup 102. This results in a tripping action, commonly referred to as a "trip," wherein the throw out arm 1025 deflects a trip paddle 112 (FIG. 1D) disposed adjacent the trip cup 102. Due to the deflection of the trip paddle 112, trip linkages 1029 (FIG. 1D) in contact with the trip paddle 112 are actuated, for example, released. Releasing the trip linkages 1029 shuts off the steam supplied to the steam turbine 100, thereby shutting off the steam turbine 100. In this manner, the steam turbine 100 is prevented from operating at overspeed.

FIG. 1C is a perspective view of the conventional steam turbine 100 of FIG. 1. Illustrated in FIG. 1 are the housing 108, the governor linkages 106, and the steam source 116. FIG. 1D is a top plan view of the trip cup 102 and the mechanical flyweight style governor 104 of the conventional steam turbine 100 of FIG. 1 contained in the housing 108. Also shown are the partially drilled hole 1023, the recess 1026, trip paddle 112, and the trip linkages 1029 connected to the steam source 116.

It has been found by those of ordinary skill in the art that the trip cup 102 may present a number of drawbacks. For example, the weight spring 1024 attached to the throw out arm 1025 may exhibit erratic behavior. As a result, sometimes the trip occurs prematurely, or sometimes the trip occurs too late. In addition, the throw out arm 1025 may break, thereby requiring replacement.

What is needed, therefore, is a steam turbine overspeed control system that provides reliable and efficient operation, requires low maintenance with ease of assembly and disassembly, and fits in the footprint of the existing trip cup.

SUMMARY

Embodiments of the disclosure may provide a method for retrofitting a turbomachine by replacing a first trip cup of the turbomachine with a second trip cup. The first trip cup may include a throw-out arm connected to a first trip cup spring, and the second trip cup may include a plunger disposed in a hole defined by the second trip cup and a plunger spring encircling the plunger in the hole. The method may include removing the first trip cup from the turbomachine, the turbomachine including a trip paddle. The method may also include installing the second trip cup in the turbomachine such that a location of the plunger in the turbomachine is the same as a location of the throw-out arm in the turbomachine when the first trip cup was installed on the turbomachine.

The method may further include adjusting a tension in the plunger spring such that, when a speed of the turbomachine exceeds a predetermined value, the plunger actuates the trip paddle located adjacent the second trip cup.

Embodiments of the disclosure may further provide a method for preventing overspeed operation of a turbomachine including a first trip cup having a throw-out arm connected to a first trip cup spring, and a mechanical flyweight governor coupled to a steam source supplying steam to the turbomachine. The mechanical flyweight governor may have a coil spring retained around a shaft of the turbomachine and governor flyweights disposed around the coil spring. The method may include removing the first trip cup from the turbomachine, the turbomachine comprising a trip paddle. The method may also include installing a second trip cup in the turbomachine such that a plunger disposed in the second trip cup is at a same location in the turbomachine as the throw-out arm of the first trip cup when the first trip cup was installed in the turbomachine. The method may further include removing the mechanical flyweight governor from the turbomachine and a first set of governor linkages coupling the mechanical flyweight governor to the steam source. The method may also include installing a mechanical-hydraulic governor in the turbomachine, the mechanical-hydraulic governor being coupled to the shaft and being coupled to the steam source via a second set of governor linkages. The method may further include adjusting a tension in a plunger spring retaining the plunger in the second trip cup such that the plunger is propelled radially outward from the second trip cup and the plunger actuates the trip paddle located adjacent the second trip cup when the turbomachine rotates at a predetermined value, the predetermined value indicative of overspeed operation of the turbomachine.

Embodiments of the disclosure may further provide a method for retrofitting a turbomachine by replacing a first trip cup of the turbomachine with a second trip cup and by replacing a mechanical flyweight governor with a mechanical-hydraulic governor. The first trip cup may include a throw-out arm connected to a first trip cup spring, and the second trip cup may include a plunger disposed in a hole defined by the second trip cup and a plunger spring encircling the plunger in the hole. The method may include removing the first trip cup and a first housing enclosing the first trip cup from the turbomachine, the turbomachine including a trip paddle. The method may also include installing the second trip cup in the turbomachine, the second trip cup being installed such that, when a speed of the turbomachine exceeds a predetermined value, the plunger propels radially outwards from the second trip cup and deflects the trip paddle disposed adjacent the second trip cup, the trip paddle being disposed such that a location of the trip paddle in the retrofitted turbomachine is the same as the location of the trip paddle when the first trip cup was installed on the turbomachine. The method may further include removing the mechanical flyweight governor from the turbomachine and a first set of governor linkages coupling the mechanical flyweight governor to a steam source supplying steam to the turbomachine. The method may also include installing the mechanical-hydraulic governor in the turbomachine, the mechanical-hydraulic governor being coupled to a shaft of the turbomachine and being coupled to the steam source via a second set of governor linkages.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
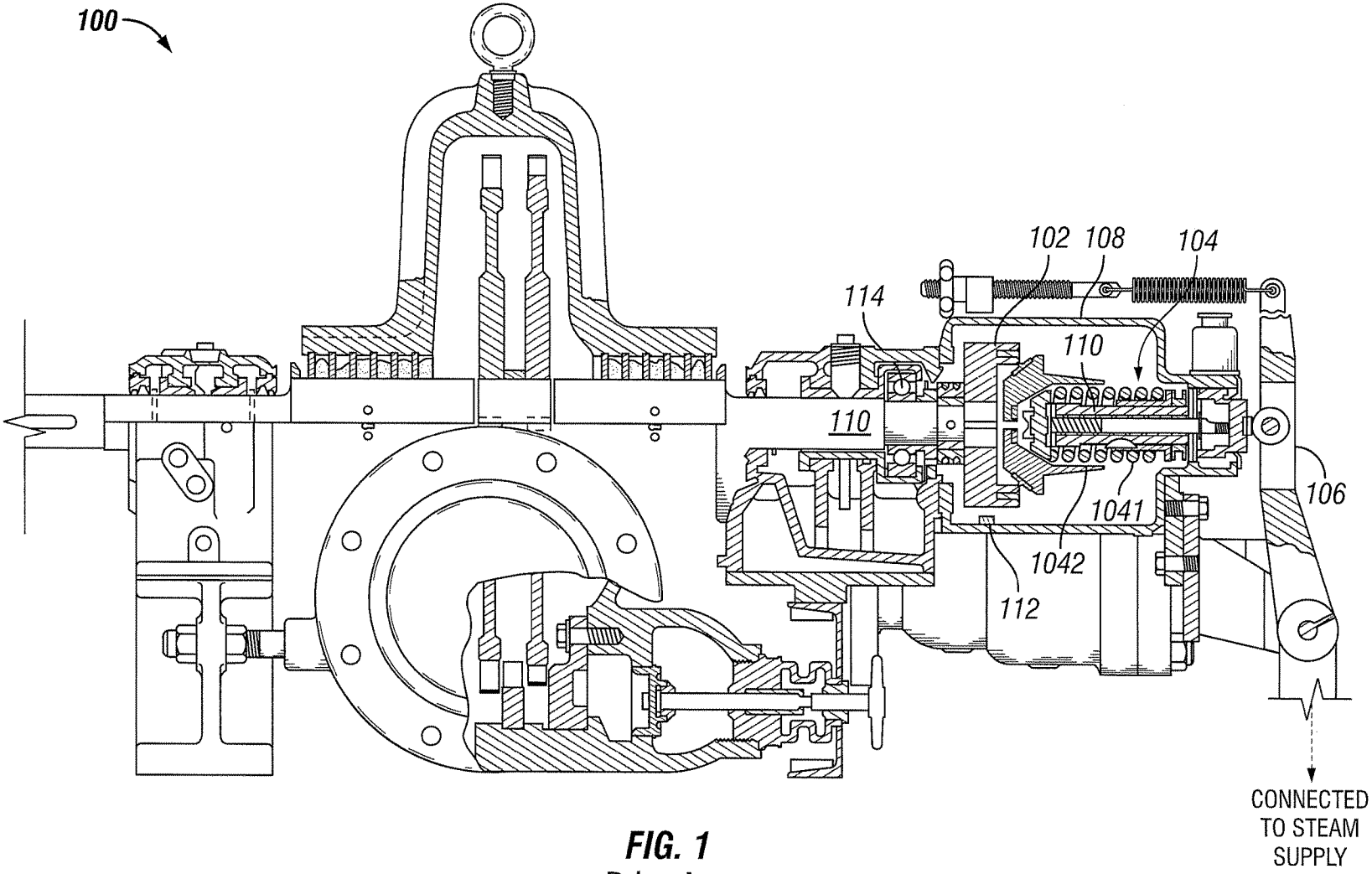
FIG. 1 illustrates a cross-sectional overview of a conventional steam turbine including a trip cup and a mechanical flyweight style governor.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
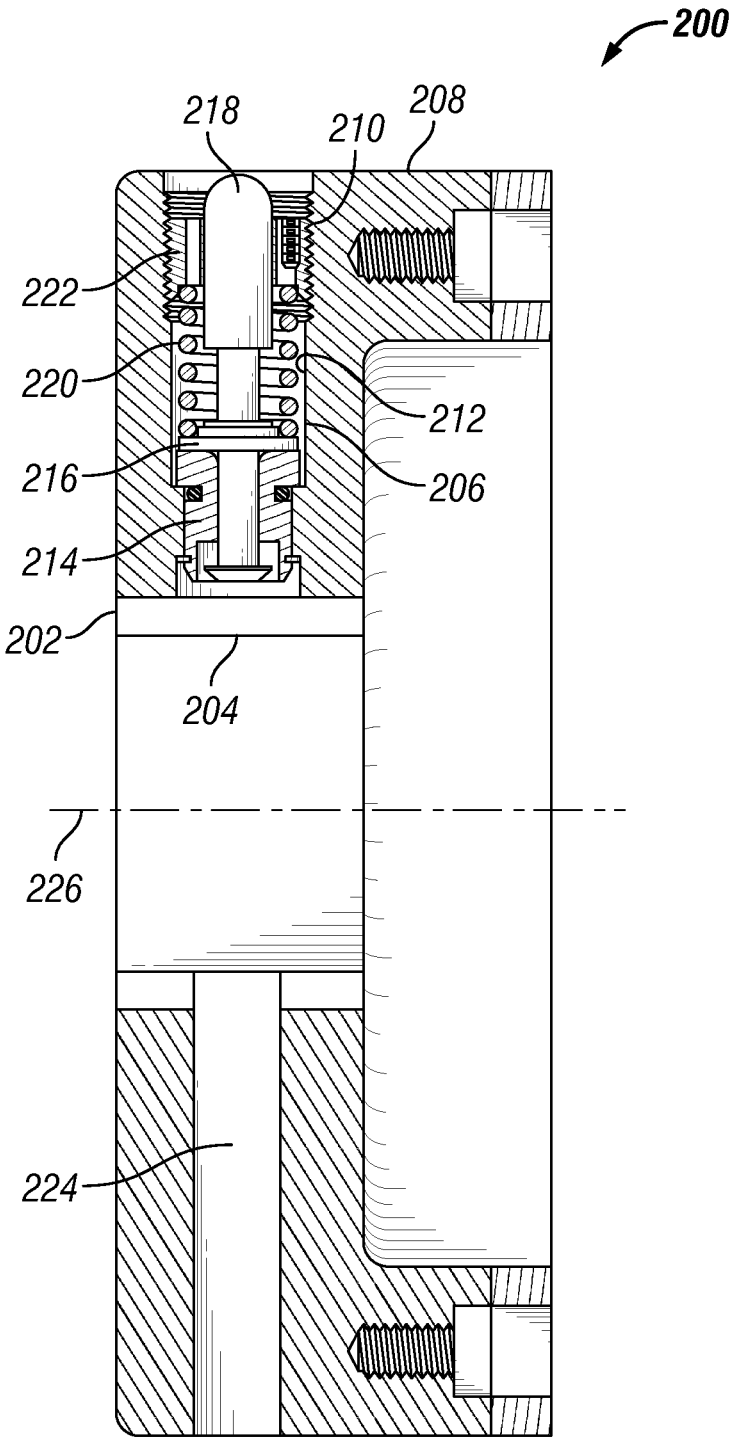
FIG. 2 illustrates a cross-sectional view of an exemplary trip cup, according to one or more embodiments disclosed.

FIG. 2 illustrates a cross-sectional view of an exemplary trip cup 200, according to one or more embodiments disclosed. In an exemplary embodiment, the steam turbine 100 illustrated in FIG. 1 may be retrofitted such that the trip cup 200 may be used in place of the trip cup 102. The trip cup 200 may have a circular disk shaped body 202 defining a central opening 204 for the shaft 110 of the steam turbine 100 to extend therethrough and a partially drilled hole 206 (also referred to as a blind hole) that may open on the outer circumferential surface 208 of the circular disk shaped body 202. A partially drilled hole or blind hole may refer to a hole that is reamed, drilled, or milled to a specified depth, thus without breaking through to the other side of the substrate, herein, the circular disk shaped body 202. The partially drilled hole 206 may extend from the outer circumferential surface 208 of the circular disk shaped body 202 radially inward towards the central opening 204.

Helical threads 210 may be defined on an inner sidewall 212 of the circular disk shaped body 202 defining the partially drilled hole 206, such that the helical threads are located adjacent the outer circumferential surface 208 of the circular disk shaped body 202. A split collar 214 may be disposed at the bottom of the partially drilled hole 206 adjacent the central opening 204 and retained therein by a retaining ring 216. The split collar 214 may support a movable pin style weight or plunger 218, as illustrated in FIG. 2. The two halves of the split collar 214 may be held together using, for example, a c-clip (not shown) after the two halves are placed around the plunger 218. A plunger spring 220 may surround the plunger 218. A spring adjustment screw 222 may be coupled to the circular disk shaped body 202 via the helical threads 210 and may surround the plunger 218, as illustrated in FIG. 2. The spring adjustment screw 222 may be adjusted to adjust the tension in the plunger spring 220.

In order to balance the trip cup 200 about the central axis 226 (or alternatively, the axis of rotation) of the trip cup 200, material of the trip cup 200 diametrically opposite to the partially drilled hole 206 may be removed. This may create a balancing hole 224 diametrically opposite the partially drilled hole 206. Although the balancing hole 224 is illustrated as a through hole in FIG. 2, the balancing hole 224 may be any particular shape or size suitable for its intended purpose. The shaft 110 may be between the partially drilled hole 206 and the balancing hole 224.

Figure 3A:
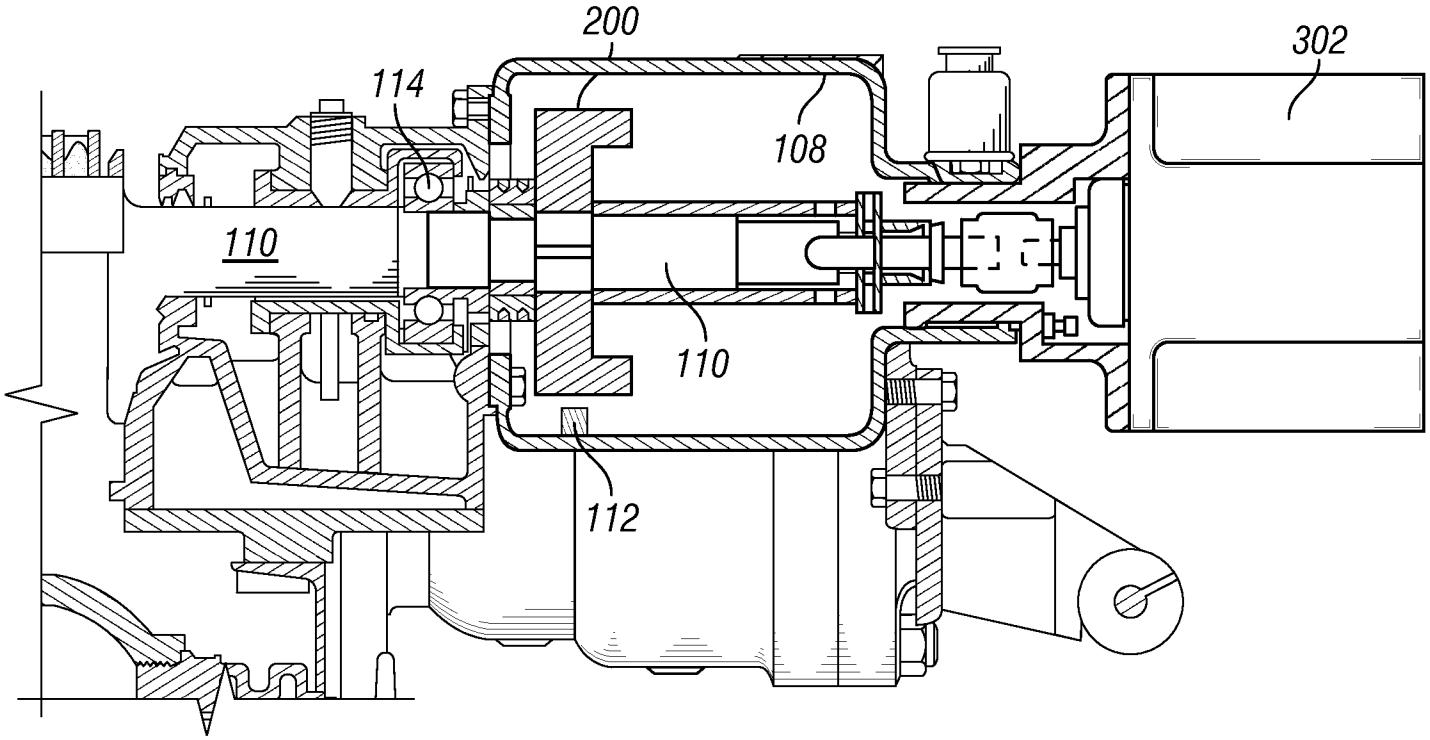
FIG. 3A illustrates a partial cross-sectional view of the steam turbine of FIG. 1 including the exemplary trip cup of FIG. 2 and a governor installed thereon, according to one or more embodiments disclosed.
Figure 3B:
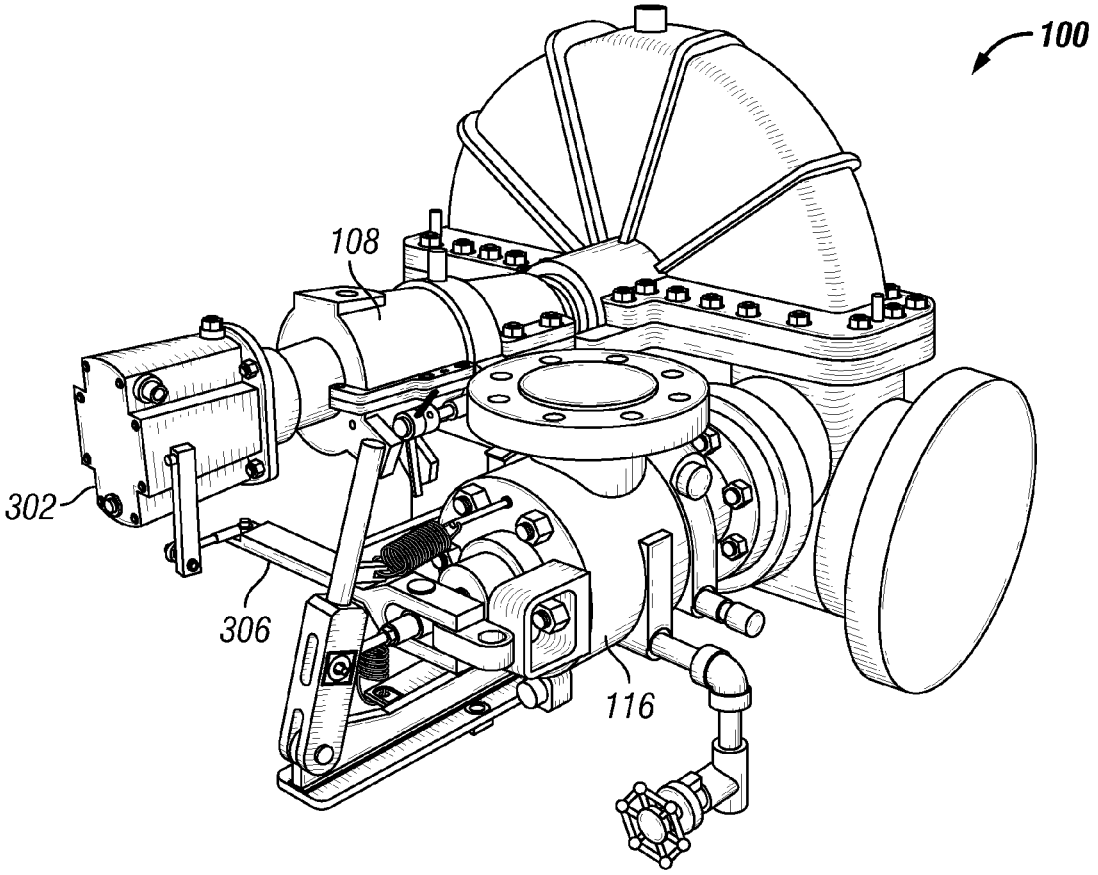
FIG. 3B illustrates a perspective view of the steam turbine of FIG. 1 with the governor installed thereon, according to one or more embodiments disclosed.

In order to install the trip cup 200 on the conventional steam turbine 100 of FIG. 1, the trip cup 102, the coil spring 1041, the two governor flyweights 1042, the outer collar 1043, and/or the governor linkages 106 of the steam turbine 100 may be removed. The trip cup 200 may be installed on the shaft 110 in place of the trip cup 102. In an example embodiment, a governor 302, for example, a mechanical-hydraulic TG-13 governor manufactured by the Woodward Governor Company of Fort Collins, Colo., may be connected to the shaft 110 at an outer end (farther from the trip cup 200) of the shaft 110 using a suitable coupling mechanism. Because the trip cup 200 may be substantially similar in dimensions to the trip cup 102, a new housing may not be required and the trip cup 200 may be contained in the housing 108 of the steam turbine 100 without substantial modification to the housing 108. FIG. 3A illustrates a partial cross-sectional view of the steam turbine 100 of FIG. 1 including the exemplary trip cup 200 of FIG. 2 and a governor 302 installed thereon, according to one or more embodiments disclosed. FIG. 3B illustrates a perspective view of the steam turbine 100 of FIG. 1 with the governor 302 installed thereon, according to one or more embodiments disclosed. As illustrated in FIG. 3B, the governor 302 may be connected to the steam source 116 using governor linkages 306. In another example embodiment, the governor 302 may not be used and the mechanical flyweight style governor 104 including the coil spring 1041 and the two governor flyweights 1042, the outer collar 1043, and/or the governor linkages 106 may be reinstalled on the conventional steam turbine 100 after the trip cup 200 has been installed.

The operation of the trip cup 200 will now be described. The tension on the plunger spring 220 may be adjusted such that, when the rotational speed of the steam turbine 100 reaches a certain predetermined value (the predetermined value may be indicative of overspeed), centrifugal forces may propel the plunger 218 radially outward from the partially drilled hole 206, and the plunger 218 may exit (at least partially) the partially drilled hole 206. The plunger 218 may contact and deflect the trip paddle 112 adjacent, e.g., around ⅛th of an inch, the outer circumferential surface 208 of the trip cup 200. The trip paddle 112 may be attached to the inner surface of the housing 108. The deflection of the trip paddle 112 may release trip linkages 1029 (FIG. 1D) which may shut off the steam supplied to the steam turbine 100 and prevent overspeed operation of the steam turbine 100.

During normal operation (below predetermined value), depending on the rotational speed of the steam turbine 100, the governor 302 or, alternatively, the mechanical flyweight style governor 104 may adjust (increases or decreases) the steam supplied to the steam turbine 100 using the governor linkages 306 (FIG. 3B) or, alternatively, the governor linkages 106 (FIG. 1C), thereby increasing or decreasing the turbine speed. For example, the rotational speed of the shaft 110 connected to the governor 302 may change the pressure inside the governor 302. Based on the change in pressure, a control system within the governor 302 may move the governor linkages 306 (FIG. 3B) connecting the governor 302 to the steam source 116 to adjust the supply of steam from the steam source 116 to the steam turbine 100. Accordingly, the governor 302 may maintain a relatively constant turbine speed.

In an exemplary embodiment, if the governor 302 or the mechanical flyweight style governor 104 malfunctions and the steam turbine 100 overspeeds, the above described tripping mechanism of the trip cup 200 is actuated and the steam turbine 100 is shut off.

The trip cup 200, according to one or more embodiments disclosed, may overcome the drawbacks presented by the trip cup 102. For example, the trip cup 200 may be more reliable than the trip cup 102 and may provide greater speed control than the trip cup 102. Adjusting the tension in the plunger spring 220 of the trip cup 200 is relatively easier than adjusting the tension in the weight spring 1024 of the trip cup 102. The trip cup 200 does not have a throw out arm 1025 that requires frequent replacement. Because the trip cup 200 may be of similar dimensions as the trip cup 102, the trip cup 200 may fit in the same housing 108 as the trip cup 102, and the trip paddle 112 and trip linkages 1029 may not require relocation. As such, the trip cup 200 may have a footprint that may be substantially the same as that of the trip cup 102.

Figure 4A:
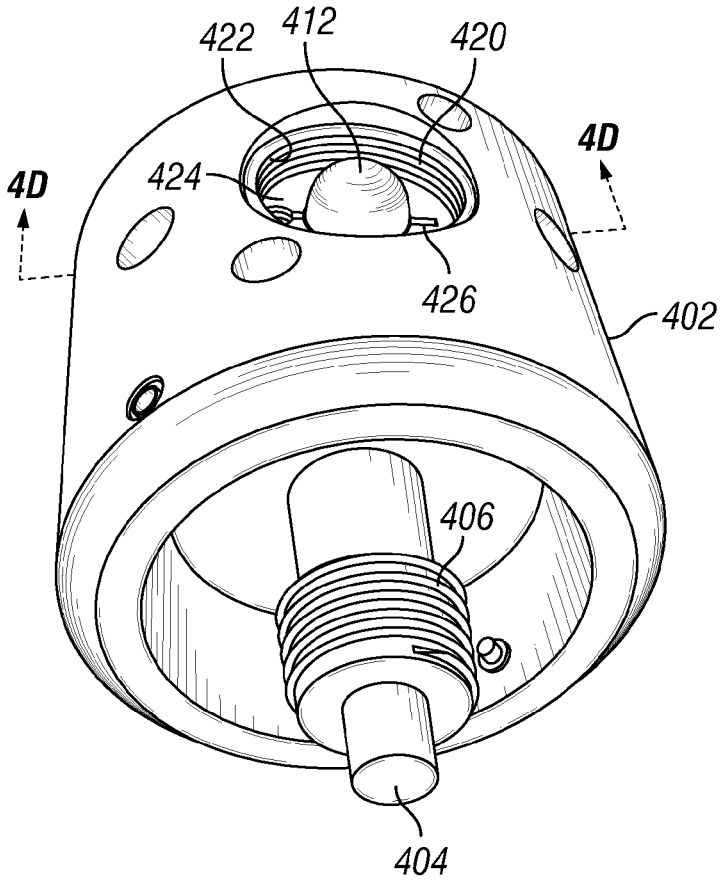
FIGS. 4A, 4B, and 4C illustrate perspective views of an exemplary trip cup, according to one or more embodiments disclosed.
Figure 4B:
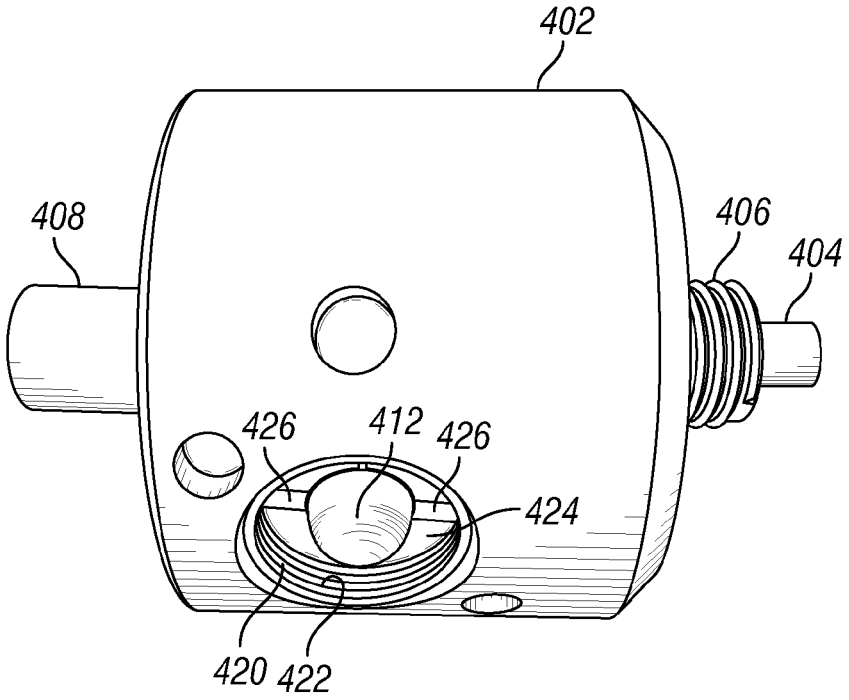
Figure 4C:
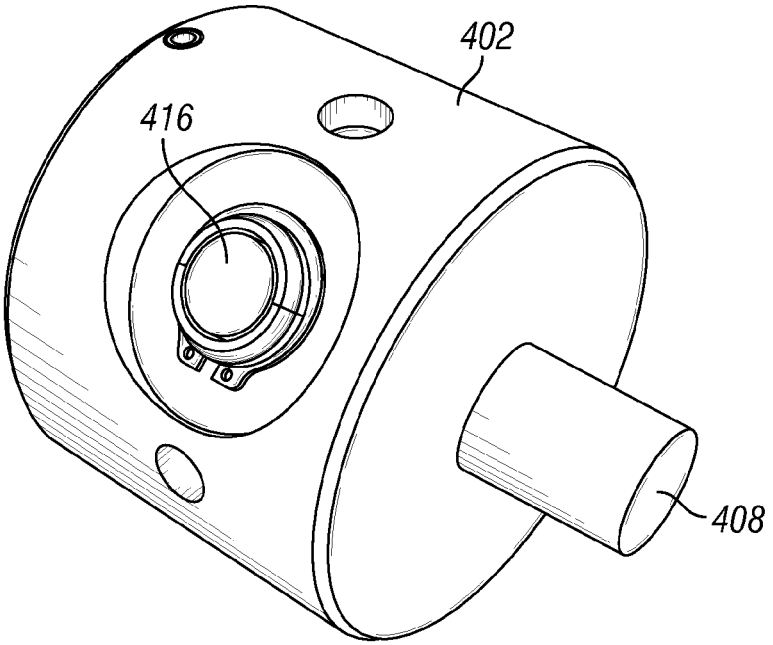

FIGS. 4A, 4B, and 4C illustrate perspective views of an exemplary trip cup 400, according to one or more embodiments disclosed. The trip cup 400 may be relatively smaller in size than the trip cup 200 and may have a cylindrical body 402. A cylindrical protrusion 404 defining helical threads 406 may extend from a first circular surface of the trip cup 400. Another cylindrical protrusion 408 may extend from a second circular surface of the trip cup 400. As shown in FIGS. 4A-4C and most clearly in FIG. 4D, the trip cup 400 may include a plunger assembly 401 including a plunger 412. The plunger 412 may be at least partially retained in and at least partially extend from a through hole 414 (FIG. 4D) defined by the cylindrical body 402. The trip cup 400 may be installed on the shaft 110 of the steam turbine 100 by coupling the cylindrical protrusion 404 to the shaft 110.

Figure 4D:
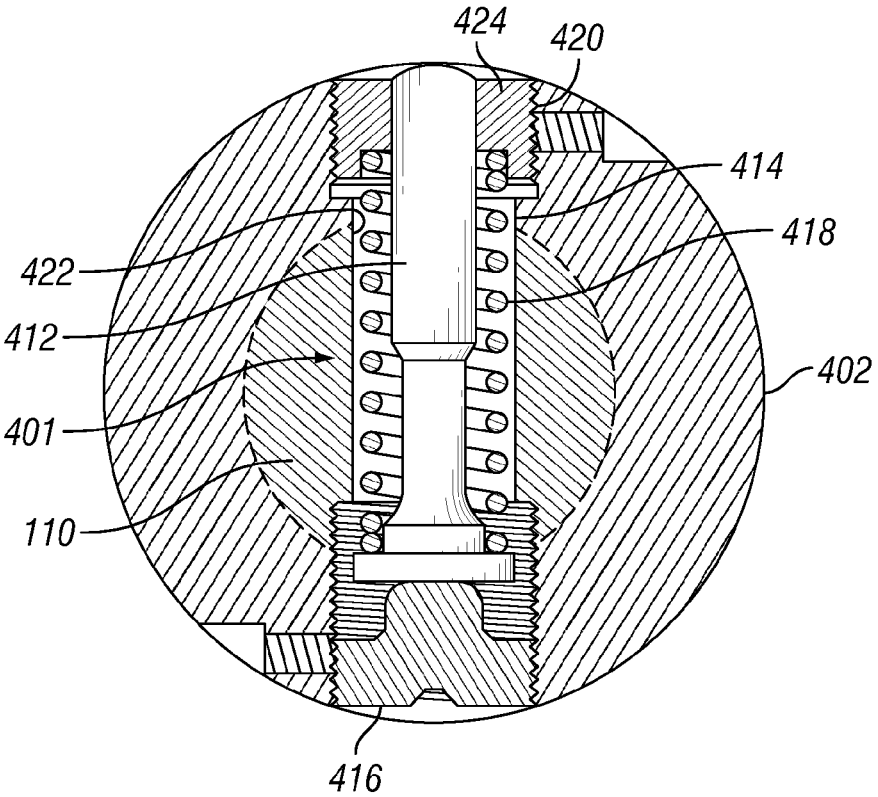
FIG. 4D illustrates a cross-sectional view, taken along the line 4D-4D in FIG. 4A, of the exemplary trip cup of FIGS. 4A, 4B, and 4C installed on the steam turbine of FIG. 1, according to one or more embodiments disclosed.

FIG. 4D illustrates a cross-sectional view of the trip cup 400 taken along the line 4D-4D in FIG. 4A. The trip cup 400 in FIG. 4D is illustrated as being installed on the shaft 110. The through hole 414 may be perpendicular to the axis of the shaft 110 and the trip cup 400, and may be defined in the center of the trip cup 400. The plunger assembly 401 may be retained in the through hole 414. The plunger assembly 401 may include a plunger adjusting screw 416 at a first end of the through hole 414. The plunger 412 may be disposed on the plunger adjusting screw 416. A plunger spring 418 may surround the plunger 412, as illustrated in FIG. 4D. Helical threads 420 may be defined on the inner sidewall 422 of the trip cup 400 defining the through hole 414, such that the helical threads are located adjacent a second end of the through hole 414 opposite the first end. A spring adjustment screw 424 may be coupled to the trip cup 400 via the helical threads 420. The spring adjustment screw 424 may be adjusted to adjust the tension in the plunger spring 418. The spring adjustment screw 424 may have notches 426 (FIGS. 4A, 4B) that may be used to adjust the spring adjustment screw 424. In an example embodiment, the plunger adjusting screw 416 may also be adjusted to further adjust the tension in the plunger spring 418.

Figure 1A:
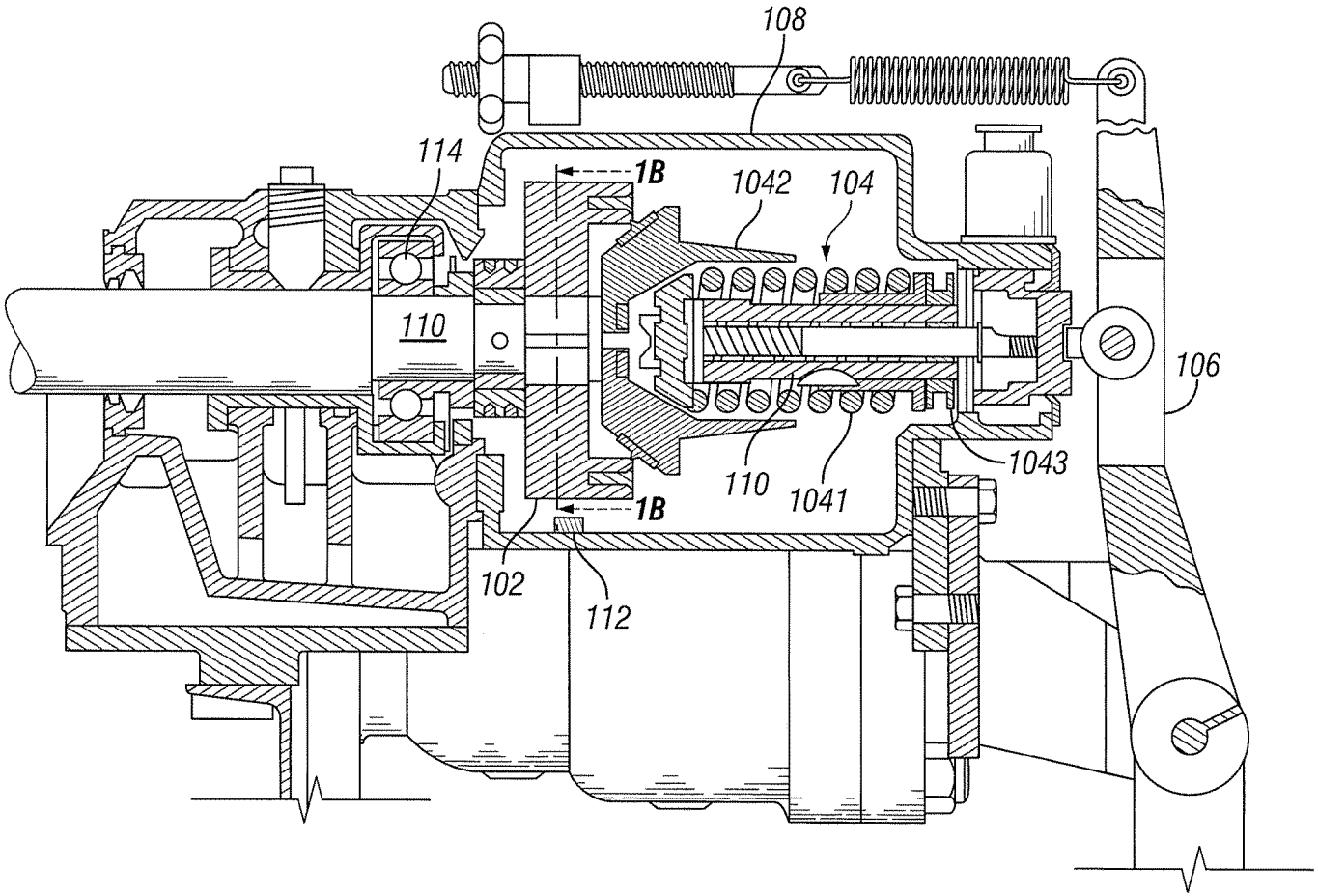
FIG. 1A illustrates an enlarged cross-sectional view of the trip cup and the mechanical flyweight style governor of the conventional steam turbine of FIG. 1.
Figure 1B:
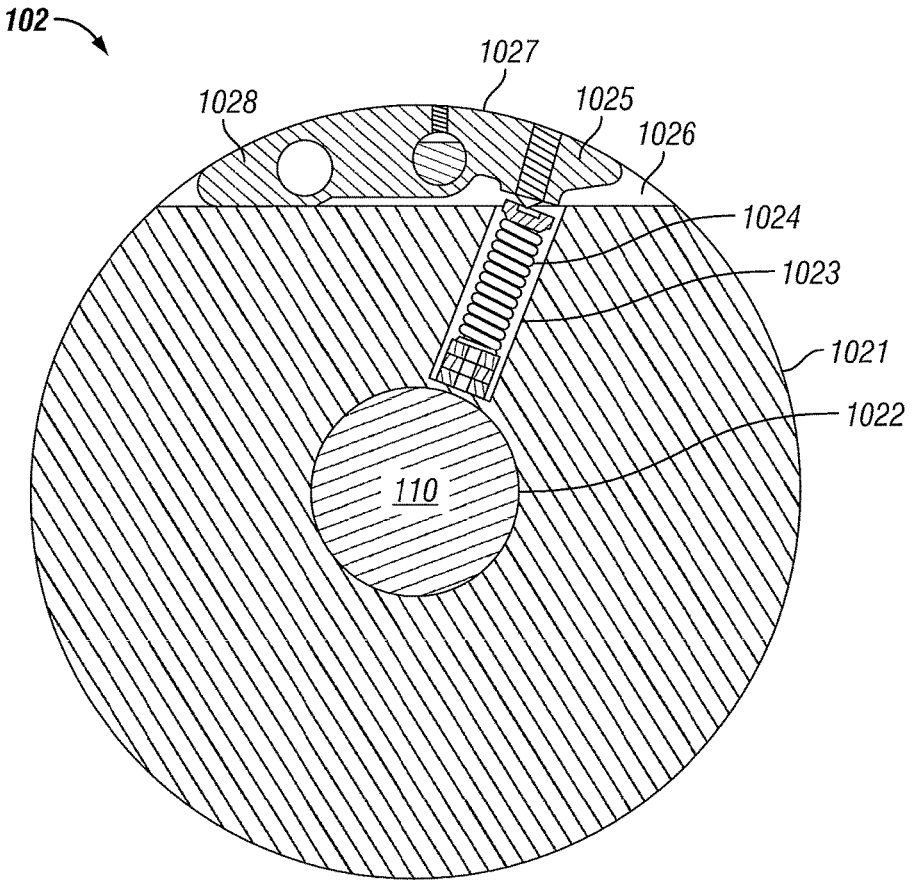
FIG. 1B illustrates a cross-sectional view of the trip cup taken along the line 1B-1B in FIG. 1A.
Figure 1C:
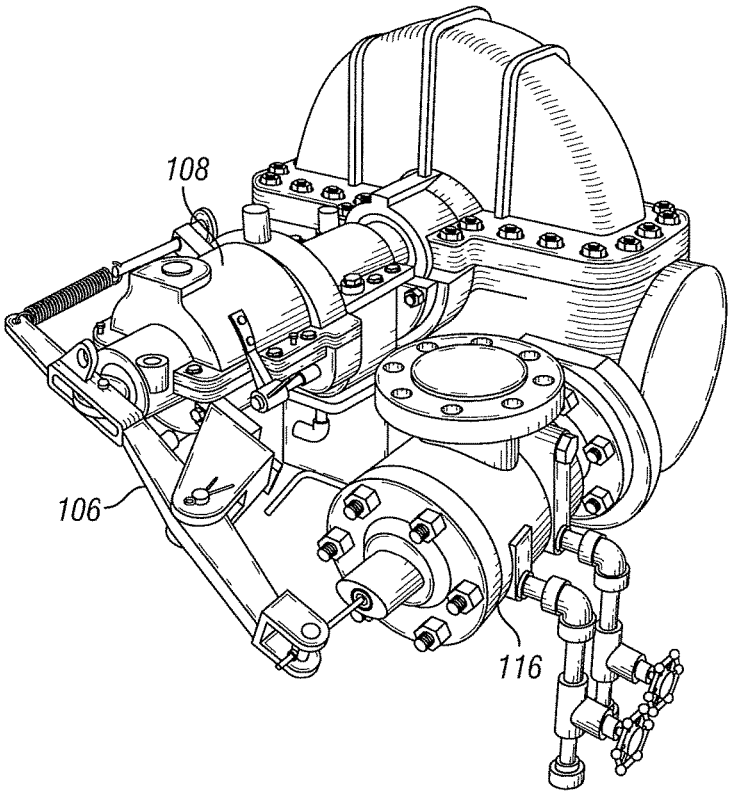
FIG. 1C illustrates a perspective view of the conventional steam turbine of FIG. 1.
Figure 1D:
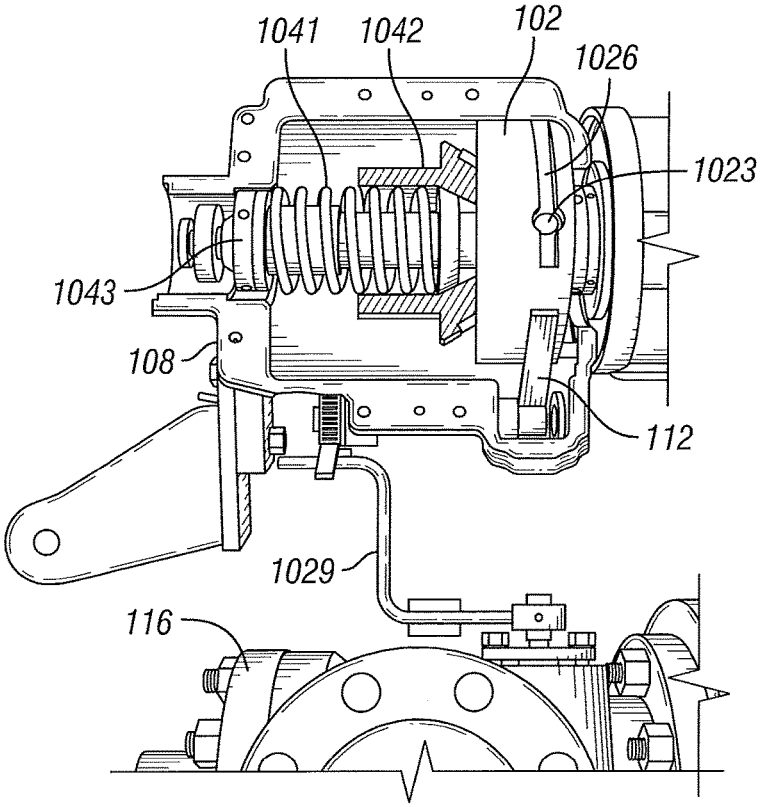
FIG. 1D illustrates a top plan view of the trip cup and the mechanical flyweight style governor of the conventional steam turbine of FIG. 1 in the housing.
Figure 5:
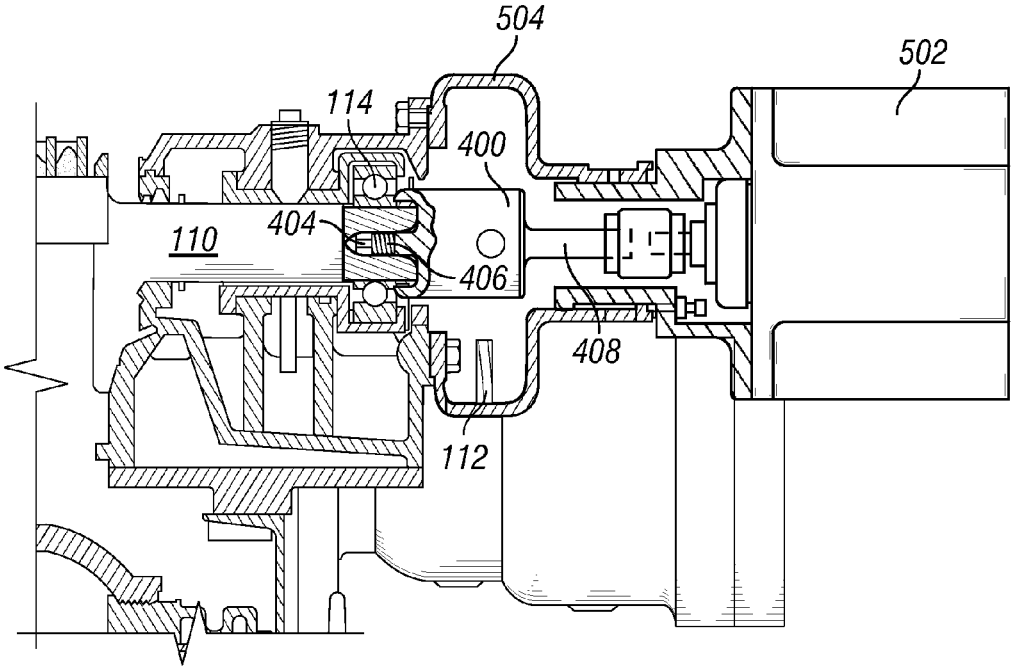
FIG. 5 illustrates a partial cross-sectional view of the steam turbine of FIG. 1 including the exemplary trip cup of FIGS. 4A, 4B, and 4C and governor installed thereon, according to one or more embodiments disclosed.

FIG. 5 illustrates a partial cross-sectional view of the trip cup 400 and a governor 502 installed on the steam turbine 100, according to one or more embodiments disclosed. In order to install the trip cup 400, the trip cup 102, the mechanical flyweight style governor 104 including the coil spring 1041 and the two governor flyweights 1042, the housing 108, the trip paddle 112, and the governor linkages 106 are removed. The shaft 110 may be removed from the steam turbine 100 and a portion of the shaft 110 adjacent the trip cup 102 may be cut perpendicular to the longitudinal axis of the shaft 110 at or adjacent the thrust bearing 114 (FIG. 1A). A shaft hole may be drilled in the center of the exposed circular surface of the shaft 110 and along the longitudinal axis of the shaft 110. The shaft hole may be a partially drilled hole. The configuration (for example, the size and shape) of the shaft hole may be such that the shaft hole may accept the cylindrical protrusion 404 of the trip cup 400. Helical grooves may also be defined on the inner surface of the shaft hole to facilitate the coupling of the cylindrical protrusion 404 of the trip cup 400 thereto. The shaft 110 may be reinstalled in the steam turbine 100 and the trip cup 400 may be screwed on the shaft 110. The trip cup 400 may be contained in a housing 504 that may be axially smaller in length than the housing 108. Due to a reduction in the length of the shaft 110, the plunger 412 of the trip cup 400, when installed on the shaft 110, may be located axially in the same position as the throw out arm 1025 of the trip cup 102. As a result, the trip paddle 112 may be reinstalled in generally the same position in the housing 504 as in the housing 108 and the trip linkages 1029 also do not require relocation. The cylindrical protrusion 408 of the trip cup 400 may be connected to a governor 502, for example, a TG-13 governor manufactured by the Woodward Governor Company of Fort Collins, Colo., using a suitable coupling mechanism.

In an exemplary embodiment, an operation of the trip cup 400 may be similar to the operation of the trip cup 200 disclosed above. When the turbine speed exceeds a predetermined value (which, for example, may indicate overspeed), the plunger 412 of the trip cup 400 may be propelled outward due to centrifugal force. The plunger 412 may actuate, for example, deflect, the trip paddle 112 and may release the trip linkages 1029, thereby shutting off the steam supplied to the steam turbine 100. During normal operation (for example, below overspeed), depending on the rotational speed of the shaft 110, the governor 502 may adjust (as mentioned above) the steam supplied to the steam turbine 100, thereby increasing or decreasing the turbine speed. As such, the governor 502 may maintain a relatively constant turbine speed.

It will be appreciated by those of ordinary skill in the art that the trip cup 400 may offer similar advantages as the trip cup 200. In addition, the trip cup 400 may be relatively more compact than the trip cup 200 and may have a relatively reduced footprint compared to the trip cup 200. For example, the trip cup 400 may have a diameter smaller than a diameter of the trip cup 200. The reduced footprint may be desirable for applications in the petro-chemical industry, for example, on oil wells or floating platforms or any other industry where space is highly restricted.

Figure 6:
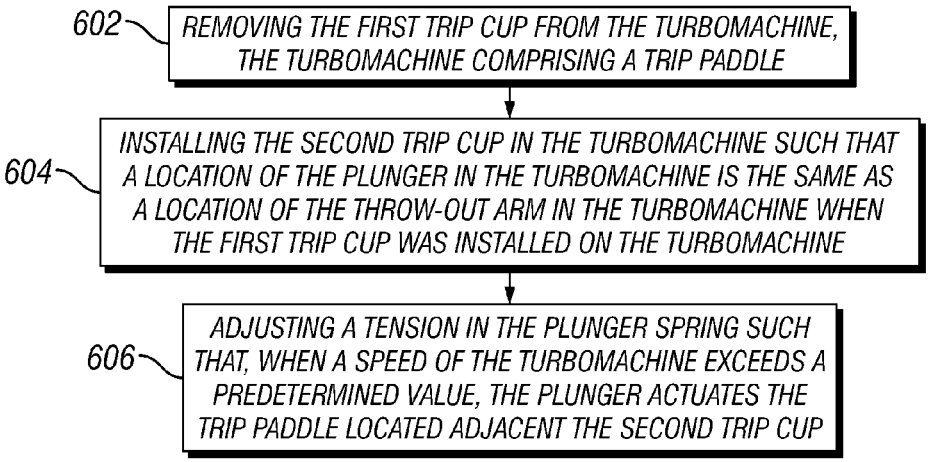
FIG. 6 is a flowchart of a method for retrofitting a turbomachine by replacing a first trip cup of the turbomachine with a second trip cup, according to one or more embodiments disclosed.

FIG. 6 is a flowchart of a method 600 for retrofitting a turbomachine by replacing a first trip cup of the turbomachine with a second trip cup. The first trip cup may include a throw-out arm connected to a first trip cup spring, and the second trip cup may include a plunger disposed in a hole defined by the second trip cup and a plunger spring encircling the plunger in the hole. The method 600 may include removing the first trip cup from the turbomachine, as shown at 602. The turbomachine may comprise a trip paddle. The method 600 may also include installing the second trip cup in the turbomachine such that a location of the plunger in the turbomachine is the same as a location of the throw-out arm in the turbomachine when the first trip cup was installed on the turbomachine, as shown at 604. The method 600 may further include adjusting a tension in the plunger spring such that, when a speed of the turbomachine exceeds a predetermined value, the plunger actuates the trip paddle located adjacent the second trip cup, as shown at 606.

Figure 7:
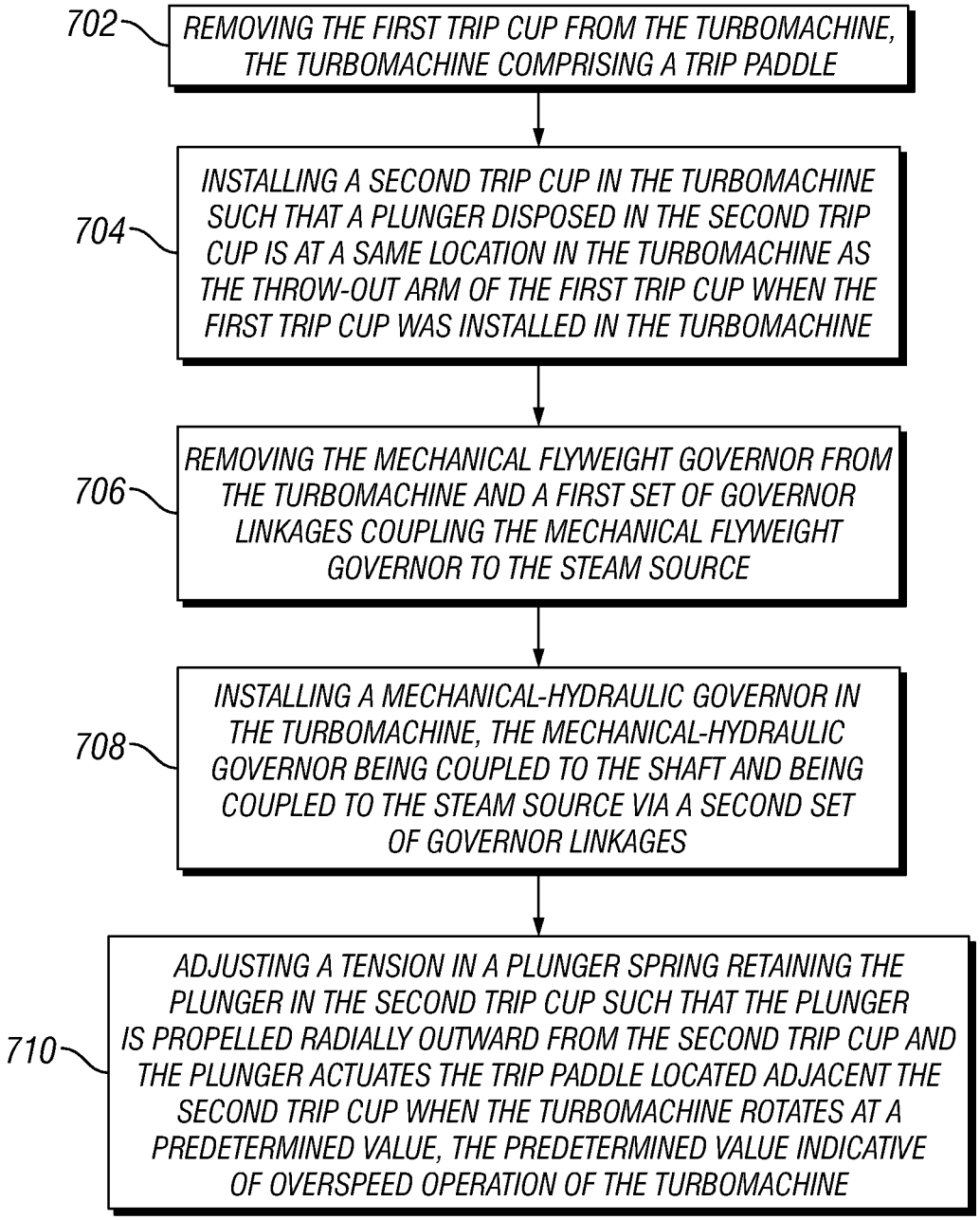
FIG. 7 is a flowchart of a method for preventing overspeed operation of a turbomachine, according to one or more embodiments disclosed.

FIG. 7 is a flowchart of a method 700 for preventing overspeed operation of a turbomachine. The turbomachine may include a first trip cup having a throw-out arm connected to a spring, and a mechanical flyweight governor coupled to a steam source supplying steam to the turbomachine. The mechanical flyweight governor may have a coil spring retained around a shaft of the turbomachine and governor flyweights disposed around the coil spring. The method 700 may include removing the first trip cup from the turbomachine, as shown at 702. The turbomachine may comprise a trip paddle. The method 700 may also include installing a second trip cup in the turbomachine such that a plunger disposed in the second trip cup is at a same location in the turbomachine as the throw-out arm of the first trip cup when the first trip cup was installed in the turbomachine, as shown at 704, and removing the mechanical flyweight governor from the turbomachine and a first set of governor linkages coupling the mechanical flyweight governor to the steam source, as shown at 706. The method 700 may further include installing a mechanical-hydraulic governor in the turbomachine, as shown at 708. The mechanical-hydraulic governor may be coupled to the shaft and may be coupled to the steam source via a second set of governor linkages. Still further, the method 700 may include adjusting a tension in a plunger spring retaining the plunger in the second trip cup such that the plunger is propelled radially outward from the second trip cup and the plunger actuates the trip paddle located adjacent the second trip cup when the turbomachine rotates at a predetermined value, as shown at 710. The predetermined value may be indicative of overspeed operation of the turbomachine.

Figure 8:
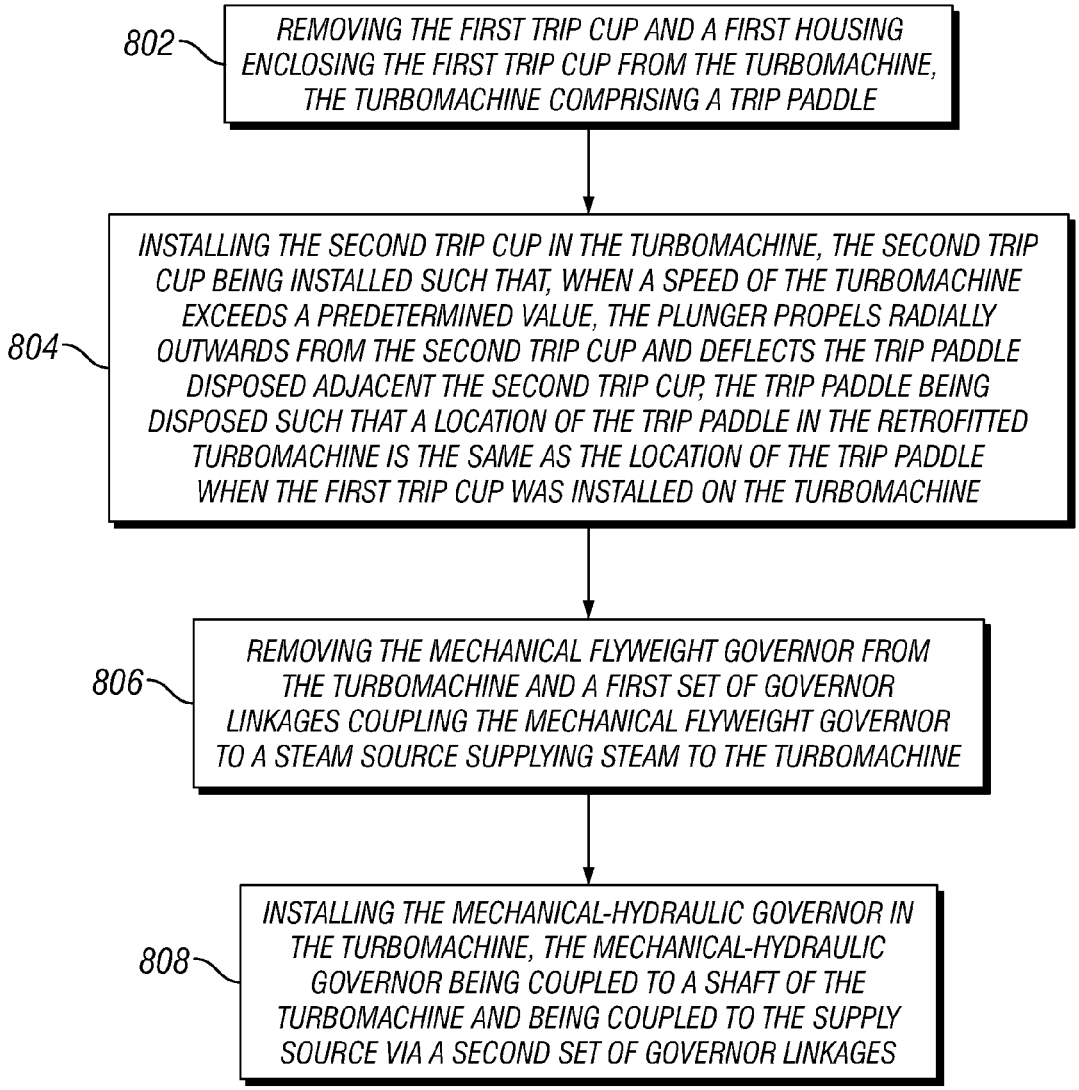
FIG. 8 is a flowchart of a method for retrofitting a turbomachine by replacing a first trip cup of the turbomachine with a second trip cup and by replacing a mechanical flyweight governor with a mechanical-hydraulic governor, according to one or more embodiments disclosed.

FIG. 8 is a flowchart of a method 800 for retrofitting a turbomachine by replacing a first trip cup of the turbomachine with a second trip cup and by replacing a mechanical flyweight governor with a mechanical-hydraulic governor. The first trip cup may include a throw-out arm connected to a spring, and the second trip cup may include a plunger disposed in a hole defined by the second trip cup and a plunger spring encircling the plunger in the hole. The method 800 may include removing the first trip cup and a first housing enclosing the first trip cup from the turbomachine, as shown at 802. The turbomachine may comprise a trip paddle. The method 800 may then include installing the second trip cup in the turbomachine, as shown at 804. The second trip cup may be installed such that, when a speed of the turbomachine exceeds a predetermined value, the plunger propels radially outwards from the second trip cup and deflects the trip paddle disposed adjacent the second trip cup. The trip paddle may be disposed such that a location of the trip paddle in the retrofitted turbomachine is the same as the location of the trip paddle when the first trip cup was installed on the turbomachine. The method 800 may also include removing the mechanical flyweight governor from the turbomachine and a first set of governor linkages coupling the mechanical flyweight governor to a steam source supplying steam to the turbomachine, as shown at 806, and installing the mechanical-hydraulic governor in the turbomachine, as shown at 808. The mechanical-hydraulic governor may be coupled to a shaft of the turbomachine and may be coupled to the steam source via a second set of governor linkages.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

We claim:

1. A method for retrofitting a turbomachine by replacing a first trip cup of the turbomachine with a second trip cup, the first trip cup including a throw-out arm connected to a first trip cup spring, and the second trip cup including a plunger disposed in a hole defined by the second trip cup and a plunger spring encircling the plunger in the hole, the method comprising:

removing the first trip cup from the turbomachine, the turbomachine comprising a trip paddle;

installing the second trip cup in the turbomachine such that a location of the plunger in the turbomachine is the same as a location of the throw-out arm in the turbomachine when the first trip cup was installed on the turbomachine; and adjusting a tension in the plunger spring such that, when a speed of the turbomachine exceeds a predetermined value, the plunger actuates the trip paddle located adjacent the second trip cup.

2. The method of claim 1, wherein the second trip cup is installed such that the location of the trip paddle in the retrofitted turbomachine is the same as the location of the trip paddle when the first trip cup was installed on the turbomachine.

3. The method of claim 2, wherein the second trip cup is installed such that a location of trip linkages relative to the retrofitted turbomachine is the same as a location of the trip linkages when the first trip cup was installed on the turbomachine.

4. The method of claim 1, wherein a diameter of the second trip cup is smaller than a diameter of the first trip cup.

5. The method of claim 4, wherein the first trip cup is enclosed in a first housing and the second trip cup is enclosed in a second housing, the second housing being axially smaller in size than the first housing.

6. The method of claim 1, wherein installing the second trip cup comprises:

reducing a length of a shaft of the turbomachine, forming a shaft hole in the center of the shaft, the shaft hole extending along at least a portion of a longitudinal axis of the shaft, and coupling the second trip cup to the shaft via the shaft hole.

7. The method of claim 6, wherein reducing the length of the shaft includes cutting the shaft perpendicular to the longitudinal axis of the shaft such that the plunger of the second trip cup is located at the same position in the turbomachine as the throw-out arm of the first trip cup.

8. The method of claim 1, further comprising:

removing a mechanical flyweight governor and a first set of governor linkages coupling the mechanical flyweight governor to a steam source from the turbomachine, the mechanical flyweight governor including a coil spring disposed around a shaft of the turbomachine and governor flyweights disposed around the coil spring;

installing a mechanical-hydraulic governor in the turbomachine; and coupling the mechanical-hydraulic governor to the steam source via a second set of governor linkages.

9. The method of claim 8, wherein a footprint of the second trip cup is substantially the same as or less than a footprint of the first trip cup.

10. The method of claim 1, wherein the tension in the plunger spring is adjusted such that, when the speed of the turbomachine exceeds the predetermined value, a centrifugal force acting on the plunger exceeds the tension in the plunger spring.

11. The method of claim 1, further comprising:

removing a mechanical flyweight governor and a first set of governor linkages coupling the mechanical flyweight governor to a steam source from the turbomachine, the mechanical flyweight governor including a coil spring disposed around a shaft of the turbomachine and governor flyweights disposed around the coil spring; and reinstalling the mechanical flyweight governor and the first set of governor linkages on the turbomachine after installing the second trip cup.

12. The method of claim 1, wherein the second trip cup is balanced about the central axis of the second trip cup by removing material of the second trip cup diametrically opposite the hole.

13. A method for preventing overspeed operation of a turbomachine including a first trip cup having a throw-out arm connected to a first trip cup spring, and a mechanical flyweight governor coupled to a steam source supplying steam to the turbomachine, the mechanical flyweight governor having a coil spring retained around a shaft of the turbomachine and governor flyweights disposed around the coil spring, the method comprising:

removing the first trip cup from the turbomachine, the turbomachine comprising a trip paddle;

installing a second trip cup in the turbomachine such that a plunger disposed in the second trip cup is at a same location in the turbomachine as the throw-out arm of the first trip cup when the first trip cup was installed in the turbomachine;

removing the mechanical flyweight governor from the turbomachine and a first set of governor linkages coupling the mechanical flyweight governor to the steam source;

installing a mechanical-hydraulic governor in the turbomachine, the mechanical-hydraulic governor being coupled to the shaft and being coupled to the steam source via a second set of governor linkages; and adjusting a tension in a plunger spring retaining the plunger in the second trip cup such that the plunger is propelled radially outward from the second trip cup and the plunger actuates the trip paddle located adjacent the second trip cup when the turbomachine rotates at a predetermined value, the predetermined value indicative of overspeed operation of the turbomachine.

14. The method of claim 13, wherein the second trip cup is installed on the shaft of the turbomachine such that the propelled plunger actuates trip linkages adjacent the second trip cup.

15. The method of claim 14, wherein a location of the trip linkages with respect to the retrofitted turbomachine is the same as a location of the trip linkages when the first trip cup was installed in the turbomachine.

16. The method of claim 13, wherein a diameter of the second trip cup is smaller than a diameter of the first trip cup.

17. The method of claim 16, wherein the first trip cup is enclosed in a first housing and the second trip cup is enclosed in a second housing, the second housing being axially smaller in size than the first housing.

18. The method of claim 13, wherein the tension in the plunger spring is adjusted such that, when the predetermined value is exceeded, a centrifugal force acting on the plunger exceeds the tension in the plunger spring.

19. The method of claim 13, wherein the second trip cup is installed such that the location of the trip paddle is the same as the location of the trip paddle when the first trip cup was installed on the turbomachine.

20. The method of claim 13, wherein installing the second trip cup comprises:

cutting the shaft perpendicular to a longitudinal axis of the shaft such that, when the second trip cup is installed, the plunger is located at the same axial position in the turbomachine as the throw-out arm when the first trip cup was installed in the turbomachine;

forming a shaft hole in the center of the shaft and along the axis of the shaft; and coupling the second trip cup to the shaft via the shaft hole.

* * * * *